US005352958A

United States Patent [19]

Cunningham et al.

[11] Patent Number: 5,352,958

[45] Date of Patent: Oct. 4, 1994

[54] LIGHTING CONTROL SYSTEM DIMMER MODULE WITH PLUG-IN ELECTRICAL CONTACTS

[76] Inventors: David W. Cunningham, 8442 Hollywood Blvd., Los Angeles, Calif. 99069; Gregory F. Esakoff, 9131 Santiago Dr., Huntington Beach, Calif. 92646

[21] Appl. No.: 978,785

[22] Filed: Nov. 19, 1992

[51] Int. Cl.[5] ..... G05F 1/00

[52] U.S. Cl. ..... 315/291; 315/307; 315/195; 439/34; 361/829

[58] Field of Search ..... 315/291, 307, DIG. 4, 315/195, 209 R; 439/34; 361/383, 384, 429

[56] References Cited

U.S. PATENT DOCUMENTS

| | | | |
|---|---|---|---|
| 3,894,265 | 7/1975 | Holmes et al. | 315/194 |
| 3,943,397 | 3/1976 | Yancey | 315/317 |
| 4,769,557 | 9/1988 | Houf et al. | 307/147 |
| 4,972,125 | 11/1990 | Cunningham et al. | 315/291 |
| 4,977,484 | 12/1990 | Cunningham et al. | 361/429 |
| 4,998,046 | 3/1991 | Lester | 315/209 R |
| 5,040,990 | 8/1991 | Suman et al. | 439/34 |

FOREIGN PATENT DOCUMENTS 0466031 1/1992 European Pat. Off. .

*Primary Examiner*—Robert J. Pascal
*Assistant Examiner*—Haissa Philogene
*Attorney, Agent, or Firm*—Pretty, Schroeder, Brueggemann & Clark

[57] ABSTRACT

A plug-in dimmer module for providing controlled power to one or more lighting fixtures or groups of fixtures. The dimmer module includes a housing with one or more circuit breakers located at one end, a power device with one or more dimmer circuits located at an opposite end, and one or more toroidal chokes located in a middle section. The power device includes built-in contacts for output power to the lighting fixture(s) and for control and sensor signals, and the dimmer module is adapted to plug directly into a slot in a rack, to engage the contacts. The components of the dimmer module are laid out efficiently within the housing, with minimal wastage of space and without the need for extraneous electrical conductors.

8 Claims, 3 Drawing Sheets

LIGHTING CONTROL SYSTEM DIMMER MODULE WITH PLUG-IN ELECTRICAL CONTACTS

BACKGROUND OF THE INVENTION

This invention relates generally to lighting control systems and, more particularly, to lighting control systems that include separate plug-in dimmer modules for each of a plurality of lighting fixtures.

Lighting control systems of this particular kind are commonly used in theater, television and architectural lighting applications. The systems typically provide controlled amounts of electrical power to each of a large number of lighting fixtures that project beams of light onto a stage or other selected area. Each dimmer module is associated with one or two lighting fixtures or groups of lighting fixtures, for controlling the amount of electrical power supplied to each fixture or group of fixtures. These modules typically are housed in a rack that is either stand-up, wall-mounted or portable, and a central controller supplies to each module a separate pulse-width modulated control signal whose pulse width controls the amount of electrical power to be supplied to each fixture or group of fixtures.

An exemplary dimmer module of the kind referred to above is disclosed in U.S. Pat. No. 4,972,125 to Cunningham et al., entitled "Plug-In Dimmer Module for Lighting Control Systems." The module includes a generally rectangular plastic housing with plug-in electrical contacts on its rearside for carrying input power, output power to the load (i.e., an associated lighting fixture), and control signals. The module depicted in the patent provides electrical power to two separate lighting fixtures or groups of fixtures. Each module includes two circuit breakers, an electronic power device for switching power to the two loads, and two toroidal chokes, one for each load. The power device includes silicon-controlled rectifiers (SCRs) for supplying controlled amounts of electrical current through the chokes to the loads in accordance with pulse-width modulated control signals supplied to the module by the central controller. The power device further includes a built-in heat sink for dissipating heat generated by the SCRs.

All external connections to the dimmer module are made via plug-in electrical contacts located on the housing's rear side such that the module conveniently can be slid into a rack to complete the connections. In particular, a single input power contact is located at one end of the housing's rear side, for delivering ac electrical power to the two circuit breakers, which are stacked one above the other at that end of the housing. Immediately adjacent to the input power contact are a number of control signal contacts which deliver control signals via separate conductors to the power device. The power device is located in a middle section of the housing, and it includes lead frames that plug directly into the circuit breakers. The toroidal chokes, which are arranged side-by-side at the end of the dimmer module's housing opposite the circuit breakers, receive controllably-switched electrical power from the power device via flat electrical leads that extend around the power device's heat sink. The chokes in turn supply the controllably-switched power to separate output contacts located at the end of the housing's rear side opposite the input contact.

The layout of components for the dimmer module described above is a logical, generally efficient arrangement; however, it is not believed to be as efficient as is possible. First, the positioning of the plug-in contacts for the control signals relative to the positioning of the power device requires the use of separate conductors for carrying the signals from one to the other. Second, the positioning of the power device in a middle section of the dimmer module's housing requires the use of separate conductors for carrying the controllably-switched electrical power around the heat sink to the toroidal chokes. These additional conductors are believed to unnecessarily complicate the dimmer module's layout.

It should therefore be appreciated that there is a need for an improved dimmer module layout that obviates the need for unnecessary electrical conductors for conveying control signals and electrical power from one component to another, yet that retains the benefits of a plug-in assembly. The present invention fulfills that need.

SUMMARY OF THE INVENTION

The present invention is embodied in a dimmer module for a lighting system in which electrical components are efficiently laid out, with minimal wastage of space, and with a reduced need for interconnecting conductors, yet which can be slid conveniently into a rack to automatically make all of the necessary electrical connections. More particularly, the dimmer module includes a housing having a first end, a second end opposite the first end, a rear, and a front opposite the rear. A plug-in electrical contact for input power is located at the rear of the housing, adjacent the first end, and a circuit breaker is located within the housing, adjacent to the first end and electrically connected to the electrical contact for input power. A toroidal inductor or choke is located in a middle section of the housing, and it is electrically connected to the circuit breaker. Further, a power device also is located within the housing, adjacent to the second end, and that power device includes a dimmer circuit, an input lead frame electrically connected to the toroidal choke, a plug-in electrical contact for delivering switched electrical power to a load, and a plurality of plug-in electrical contacts for control signals. All of the power device's contacts face the rear of the housing, and these contacts, as well as the contact for input power, are automatically engaged when the dimmer module is slid into an appropriate rack.

The dimmer module thus has an efficient layout in which the electrical connections between the successive components are made in a direct fashion. No electrical conductors must physically bypass any physical obstructions or any intervening electrical components in the same circuit.

In another feature of the invention, the power device further includes a temperature sensor, an output current sensor, and an output voltage sensor. Signals from these three sensors are all supplied to the plurality of plug-in electrical contacts, for communication outside the dimmer module. Further, visible indicators (e.g., light-emitting diodes) for indicating the status of predetermined variables (e.g., output voltage and control signal duty cycle) are located on a portion of the power device facing the front of the housing, whereby they can be readily observed when the dimmer module is installed and operating. A heat sink is located on the side of the power device immediately adjacent to the second end of the housing. In this position, the heat sink does not physically interfere with the conduction of any control signals or output power signals.

The dimmer module can be adapted to provide controlled electrical power to two separate lighting fixtures or groups of fixtures. In that case, the module includes two circuit breakers arranged one atop the other adjacent the first end of the housing and two toroidal chokes arranged side-by-side in the middle section of the housing.

Other features and advantages of the present invention should become apparent from the following description of the preferred embodiment, taken in conjunction with the accompanying drawings, which illustrate, by way of example, the principles of the invention.

DESCRIPTION OF THE PREFERRED EMBODIMENT

Figure 1:
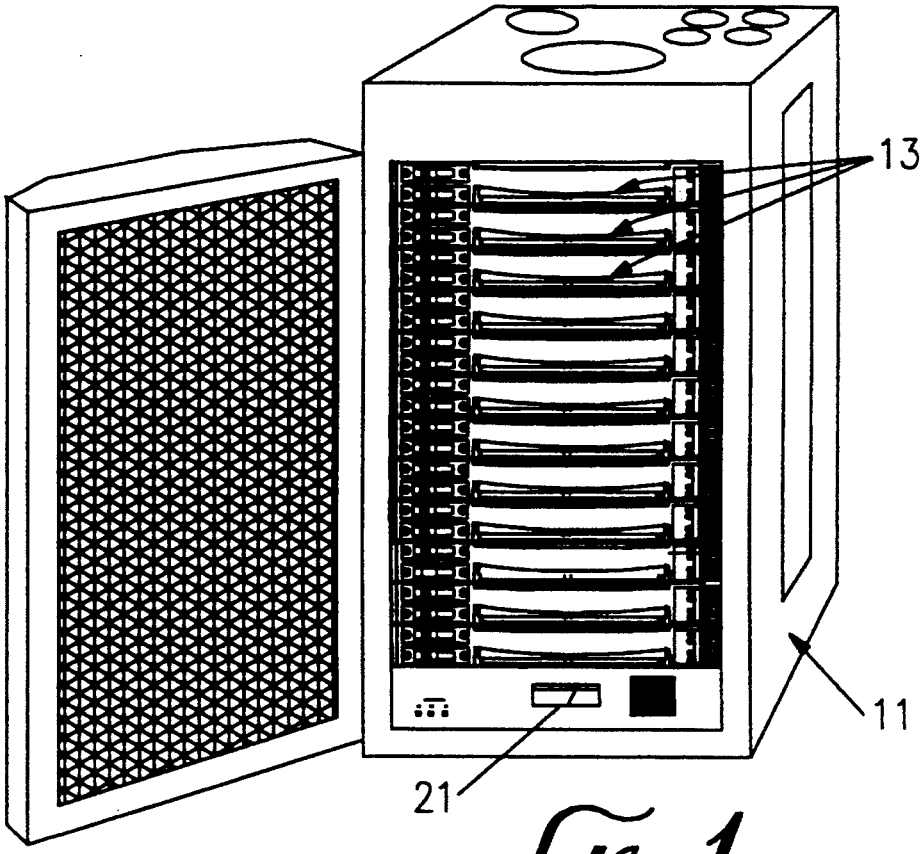
FIG. 1 is a perspective view of a rack for carrying twelve separate dimmer modules embodying the present invention, with a door of the rack shown in its open position to reveal the dimmer modules, each dimmer module providing a controlled amount of power to two separate lighting fixtures or groups of fixtures.
Figure 2:
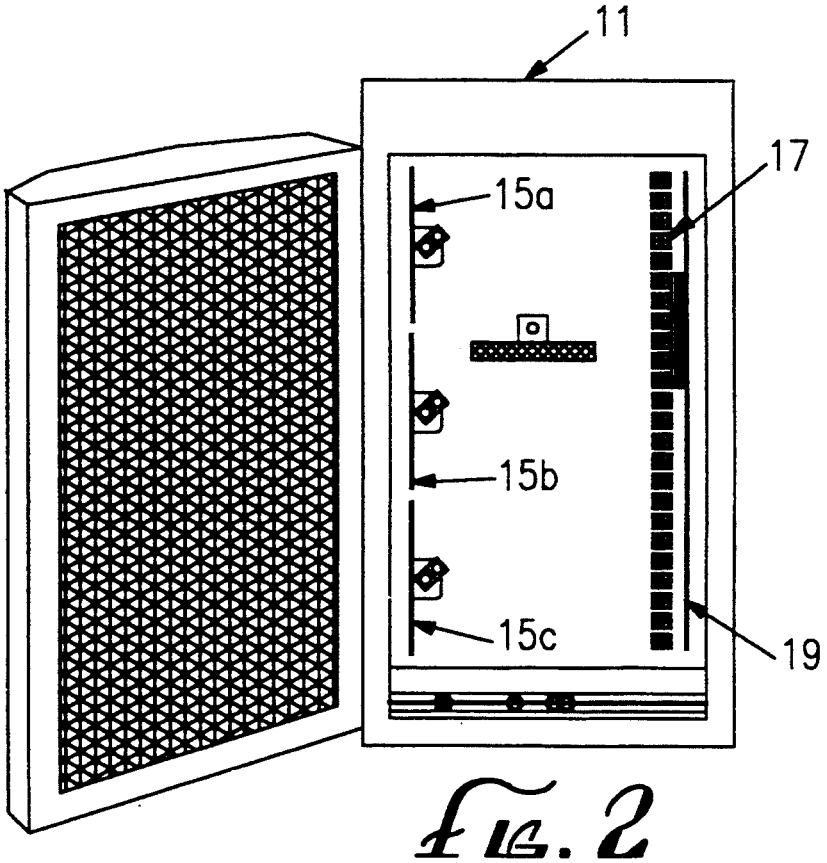
FIG. 2 is a front elevational view of the dimmer module rack of FIG. 1, shown with the twelve dimmer modules removed.

With reference now to the drawings, and particularly to FIGS. 1 and 2, there is shown a rack 11 for carrying twelve dimmer modules 13, each module providing a controlled amount of electrical power to two separate lighting fixtures or groups of fixtures (not shown). The dimmer rack and dimmer modules are part of a dimmable lighting system useful in theater, television and architectural lighting applications. FIG. 2 depicts the dimmer rack 11 with all twelve of the dimmer modules 13 removed. The exposed rear panel of the rack is depicted to include three input power buses 15*a*, 15*b* and 15*c* along its left side, 24 load connectors 17 along its right side, and a printed circuit (PC) board 19 also along its right side. The PC board distributes control signals and sensor signals to and from the dimmer modules. The three input power buses each carry a separate phase of a standard three phase ac power line. Alternatively, the buses may be combined for single- or split-phase operation.

The rack 11 is configured such that each dimmer module 13 can be slid conveniently into it, to engage one of the three power buses 15*a*, 15*b* or 15*c*, two of the load connectors 17, and a plurality of signal conductors on the signal distribution PC board 19. A control module 21 is located at the bottom of the rack, for transmitting certain control signals via the PC board to the twelve dimmer modules and for receiving back and evaluating certain sensor signals generated by the dimmer modules.

Figure 3:
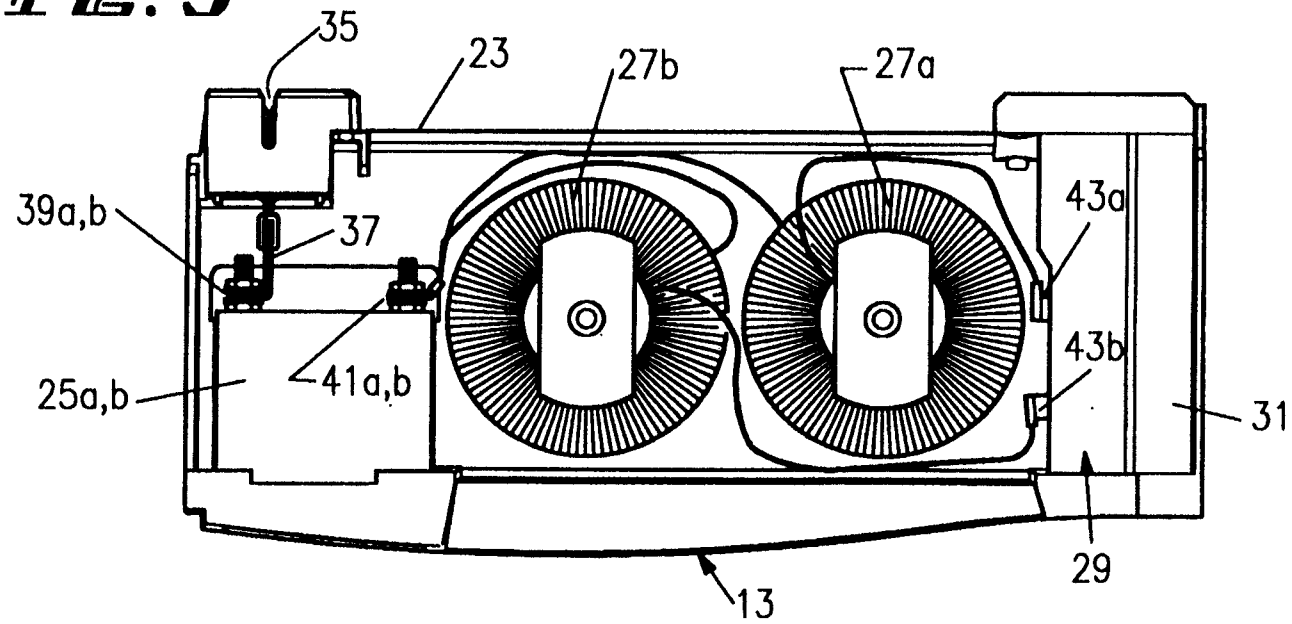
FIG. 3 is a top plan view of a dimmer module embodying the present invention.
Figure 4:
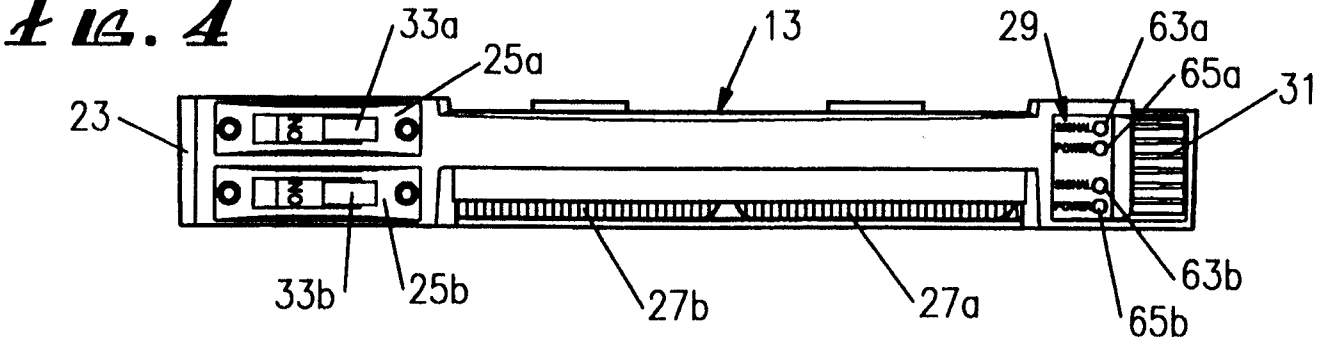
FIG. 4 is a front elevational view of the dimmer module of FIG. 3.
Figure 5:
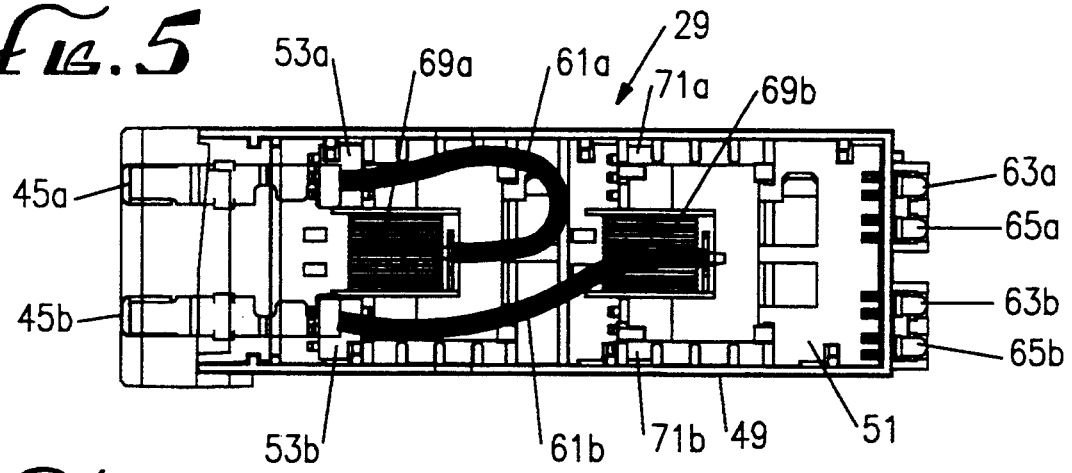
FIG. 5 is a top plan view of power device located on its side in the right-most section of the dimmer module of FIG. 3.
Figure 6:
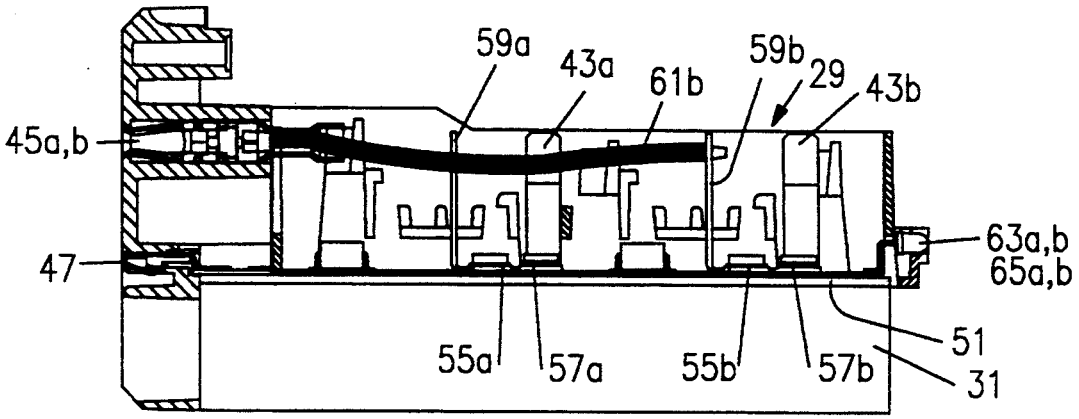
FIG. 6 is a side elevational view of the power device of FIG. 5.
Figure 7:
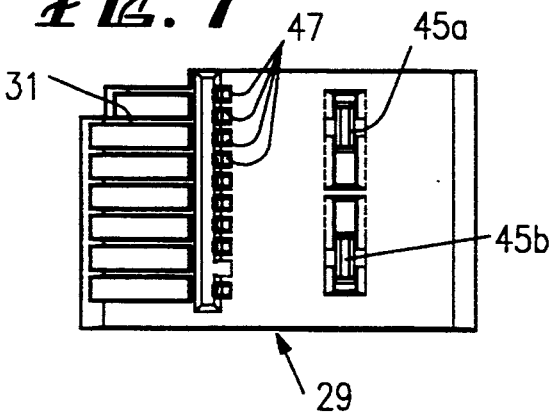
FIG. 7 is a rear elevational view of the power device of FIG. 5.
Figure 8:
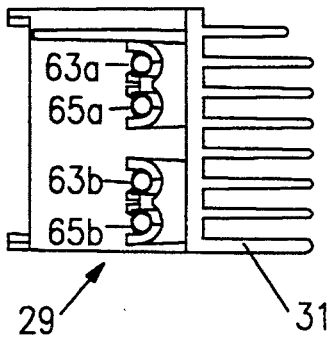
FIG. 8 is a front elevational view of the power device of FIG. 5.

FIGS. 3 and 4 depict the dimmer module 13 used in the dimmer rack 11 of FIG. 1. The module provides controlled amounts of electrical power to two separate lighting fixtures or groups of fixtures (not shown). The module includes a generally rectangular, open-topped, die-cast aluminum housing 23 with two circuit breakers 25*a* and 25*b* stacked one above the other in the left section of the housing, two toroidal inductors or chokes 27*a* and 27*b* arranged side-by-side in a middle section of the housing, and a power device 29 with a built-in heat sink 31 in the right section of the housing. The circuit breakers 25*a* and 25*b* each include a finger switch 33*a* or 33*b* that is exposed through an opening in the front side of the housing, to allow the circuit breakers conveniently to be reset or switched ON or OFF.

A plug-in contact 35 for input electrical power is located on the rearside of the housing 23, at its left end. The contact is sized and positioned to engage one of the three input power busses 15*a*, 15*b* or 15*c* depicted in FIG. 2. An extension 37 of this input power contact is connected to input terminals 39*a* and 39*b* of the respective circuit breakers 25*a* and 25*b*. Output terminals 41*a* and 41*b* of the circuit breakers are connected directly to the lead wires of the chokes 27*a* and 27*b*, respectively. The other lead wires of the chokes are connected, in turn, to the power device 29 via lead frames 43*a* and 43*b*, respectively, projecting leftwardly from the power device.

The power device 29 includes two plug-in load contacts 45*a* and 45*b* for delivering controllably-switched output power to two separate lighting fixtures or groups of fixtures (not shown) and further includes a plurality of signal contacts 47 arranged in a linear row for carrying control signals and sensor signals to and from circuitry included in the power device. The load contacts 45*a* and 45*b* and the signal contacts 47 face rearwardly on the power device, and they are sized and positioned to be engageable with the load connectors 17 and the signal distribution PC board 19 included in the dimmer module rack 11 (FIG. 2). The signal contacts 47 are attached directly to a substrate 51 of the power device.

It will be appreciated that the interconnections between the successive electrical components in the dimmer module 13 are all made in a direct fashion, without the need for any extraneous electrical conductors. Each interconnection is made without the need for physically bypassing any physical obstructions or any electrical components from the same circuits. This result is achieved by arranging the components in the manner described, with the power device 29 located at the far right side of the dimmer module 13 and with the load contacts 45*a* and 45*b* and the signal contacts 47 being carried by the power device, itself, for engagement with the corresponding rack connectors 17 and 19 when the dimmer module is fully installed.

FIGS. 5–8 more particularly show the components and layout of the power device 29. The device includes a molded plastic housing 49 with an extruded aluminum heat sink 29 projecting downwardly from its underside, which is toward the right when the device is installed in the dimmer module 13, as shown in FIGS. 3 and 4. The load contacts 45*a* and 45*b* and the signal contacts 47 are shown at the left side of FIG. 5, which faces rearwardly in the dimmer module housing (FIGS. 3 and 4).

A bottom wall of the housing 49 is defined by the substrate 51 that carries circuitry for controllably switching power for the lighting fixtures or groups of fixtures. One suitable arrangement for this circuitry is disclosed in copending and commonly-assigned U.S. patent application Ser. No. 07/759,500, entitled "DIMMING CONTROL CIRCUIT" which is incorporated by reference. As is conventional, this circuitry includes two opto-isolator devices 53*a* and 53*b* and four silicon-controlled rectifiers 55*a*, 55*b*, 57*a*, and 57*b*. The SCRs 55*a* and 57*a* are arranged in parallel, opposed relationship, and they cooperate with the opto-isolator 53*a* for providing controllably-switched power through the first load contact 45*a* to the first lighting fixture or group of fixtures. Similarly, the SCRs 55*b* and 57*b* are arranged in parallel, opposed relationship, and they cooperate with the opto-isolator 53*b* for providing controllably-switched power through the second output power contact 45*b* to the second lighting fixture or group of fixtures. As previously mentioned, lead frames 43*a* and 43*b* project upwardly from the substrate 51, for direct connection to the respective toroidal chokes 27*a* and 27*b*. Two additional lead frames 59*a* and 59*b* also project upwardly from the substrate, and jumper wires 61*a* and 61*b* interconnect these lead frames with the respective load contacts 45*a* and 45*b*.

The lead frames 43*a*, 43*b*, 59*a* and 59*b* and the various electrical components are mounted on the substrate 51 and connected together in a conventional fashion. One suitable fashion is described in U.S. Pat. No. 4,972,125.

As is conventional, pulse-width modulated signals are supplied to the power device by the control module 21 (FIG. 1), for controllably biasing ON the SCRs 55*a*, 55*b*, 57*a* and 57*b*, for powering the lighting fixtures at selected levels. These control signals are supplied to the power device via the PC board 19 and three of the signal contacts 47.

Four light-emitting diodes (LEDs) 63*a*, 63*b*, 65*a* and 65*b* are positioned on the power device 29 such that they are visible from the front side of the rack 11 when the power device is mounted in the dimmer module housing 23. Circuitry on the substrate 51 of the power device is arranged such that the LEDs 63*a* and 63*b* are illuminated proportionally to the pulse widths of the control signals being received for powering the respective first and second lighting fixtures or group of fixtures. Conversely, the LEDs 65*a* and 65*b* are illuminated proportionally to the voltage being transmitted by the SCRs 55*a*, 55*b*, 57*a* and 57*b*.

The power device 29 further includes a thermistor 67 (FIG. 5) whose resistance varies in accordance with the temperature of the power device. A voltage signal representative of this resistance is transmitted from the power device via one of the plurality of signal contacts 47. Current sensors 69*a* and 69*b* and voltage sensors 71*a* and 71*b* (FIG. 5) generate signals representative of the magnitudes of the electrical current and electrical voltage supplied by the dimmer module to each of the lighting fixtures or groups of fixtures. These signals are transmitted from the power device via four of the signal contacts 47.

After the power device 29 has been fully assembled, it is encapsulated in a potting material (not shown) for protecting and insulating the circuit components. The potting material extends completely across the substrate 51 of the device. The lead frames 43*a*, 43*b*, 59*a* and 59*b* project upwardly and out of the potting material to allow their convenient electrical connection to the chokes 27*a* and 27*b* and load contacts 45*a* and 45*b*, respectively.

The dimmer module housing 23 is configured to facilitate cooling of the module's components. In particular, vents are provided in the housing's front and rear sides, to allow a fan (not shown) mounted in a top section of the rack 11 to draw air across the chokes 27*a* and 27*b* and through the heat sink 31 of the power device 29. Although dimmer module housing 23 is open-topped, air flows predominantly through the vents because another dimmer module housing generally is located immediately above it, as shown in FIG. 1.

It should be appreciated from the foregoing description that the present invention provides a plug-in dimmer module having an efficient layout of components, with minimal wastage of space and without the need for extraneous electrical conductors. A power device of the module includes built-in contacts for output power to the load and for control and sensor signals, and the dimmer module is adapted to plug directly into a slot in a rack, to engage the contacts.

Although the invention has been described in detail with reference only to the presently-preferred embodiment, those of ordinary skill in the art will appreciate that various modifications can be made without departing from the invention. Accordingly, the invention is defined only by the following claims.

We claim:

1. A dimmer module comprising:

a housing having a first end, a second end opposite the first end, a rear, and a front opposite the rear, the housing including a plug-in electrical contact for input power at its rear, adjacent the first end;

a circuit breaker located within the housing, adjacent the first end of the housing and electrically connected to the electrical contact for input power;

a toroidal inductor located within the housing and electrically connected to the circuit breaker; and a power device located within the housing, adjacent the second end of the housing, the power device including a dimmer circuit, an input lead frame electrically connected to the toroidal inductor, a plug-in electrical contact for a load facing the rear of the housing, and a plurality of plug-in electrical contacts for control signals facing the rear of the housing;

wherein the dimmer module is configured such that it can be slid into a rack and automatically engage the plug-in electrical contacts for input power, the load, and control signals.

2. A dimmer module comprising:

a housing having a first end, a second end opposite the first end, a rear, and a front opposite the rear, the housing including a plug-in electrical contact for input power at its rear, adjacent the first end;

a circuit breaker located within the housing, adjacent the first end of the housing and electrically connected to the electrical contact for input power;

a toroidal inductor located within the housing and electrically connected to the circuit breaker; and a power device located within the housing, adjacent the second end of the housing, the power device including a dimmer circuit, an input lead frame electrically connected to the toroidal inductor, a plug-in electrical contact for a load facing the rear of the housing, a temperature sensor, an output current sensor, an output voltage sensor and a plurality of plug-in electrical contacts for control signals facing the rear of the housing, including contacts for carrying signals from the temperature, output current, and output voltage sensors;

wherein the dimmer module is configured such that it can be slid into a rack and automatically engage the plug-in electrical contacts for input power, the load, and control signals.

3. A dimmer module as defined in claim 2, wherein the power device further includes a visible indicator for indicating the status of a predetermined parameter, the indicator being located on a portion of the power device facing the front of the housing, opposite the plug-in electrical contacts for the load and for the control and sensor signals.

4. A dimmer module as defined in claim 1, wherein the power device further includes a heat sink in thermal transfer relationship with the dimmer circuit, the heat sink being located immediately adjacent the second end of the housing, on the side of the dimmer circuit opposite the toroidal inductor.

5. A dimmer module as defined in claim 1, wherein the electrical connections between the plug-in electrical contact for input power and the circuit breaker, between the circuit breaker and the toroidal inductor, and between the toroidal inductor and the power device, are made without the use of electrical conductors for physically bypassing any intervening physical obstruction or any intervening electrical components.

6. A dimmer module for providing controlled electrical power to two separate lighting fixtures or groups of lighting fixtures, the dimmer module comprising:

a generally rectangular housing having a first side wall, a second side wall opposite the first side wall, a rear wall, and a front wall opposite the rear wall, the housing including a plug-in input power contact on its rear wall, adjacent to the first side wall;

first and second circuit breakers located one above the other within the housing, adjacent the first side wall and electrically connected to the electrical contact for input power;

first and second toroidal inductors located side-by-side within the housing, adjacent the first and second circuit breakers and electrically connected to the respective first and second circuit breakers; and a power device located within the housing, between the first and second toroidal inductors and the housing's second side wall, the power device including a substrate, first and second dimmer circuits mounted on the substrate, first and second input lead frames interconnecting the respective first and second toroidal inductors with the respective first and second dimmer circuits, first and second plug-in load contacts facing the rear wall of the housing, for supplying electrical power from the respective first and second dimmer circuits to the two lighting fixtures or groups of fixtures, a plurality of plug-in signal contacts mounted on the substrate and facing the rear wall of the housing, and a heat sink in thermal transfer relationship with the first and second dimmer circuits, the heat sink being located immediately adjacent the housing's second side wall, on the side of the substrate opposite the first and second toroidal inductors;

wherein the dimmer module is configured such that it can be slid into a rack to automatically engage the plug-in input power contact, first and second load contacts, and plurality of signal contacts.

7. A dimmer module for providing controlled electrical power to two separate lighting fixtures or groups of lighting fixtures, the dimmer module comprising:

a generally rectangular housing having a first side wall, a second side wall opposite the first side wall, a rear wall, and a front wall opposite the rear wall, the housing including a plug-in input power contact on its rear wall, adjacent to the first side wall;

first and second circuit breakers located one above the other within the housing, adjacent the first side wall and electrically connected to the electrical contact for input power;

first and second toroidal inductors located side-by-side within the housing, adjacent the first and second circuit breakers and electrically connected to the respective first and second circuit breakers; and a power device located within the housing, between the first and second toroidal inductors and the housing's second side wall, the power device including a substrate;

first and second dimmer circuits mounted on the substrate, first and second input lead frames interconnecting the respective first and second toroidal inductors with the respective first and second dimmer circuits, first and second plug-in load contacts facing the rear wall of the housing, for supplying electrical power from the respective first and second dimmer circuits to the two lighting fixtures or groups of fixtures, a temperature sensor mounted on the substrate, first and second output current sensors mounted on the substrate, for sensing the magnitude of electrical current being delivered to the two lighting fixtures or groups of fixtures, first and second output voltage sensors mounted on the substrate, for sensing the magnitude of the voltage being applied to the two lighting fixtures or groups of fixtures, a plurality of plug-in signal contacts mounted on the substrate and facing the rear wall of the housing, for carrying signals from the temperature sensor, the first and second output current sensors, and the first and second output voltage sensors, and a heat sink in thermal transfer relationship with the first and second dimmer circuits, the heat sink being located immediately adjacent the housing's second side wall, on the side of the substrate opposite the first and second toroidal inductors;

wherein the dimmer module is configured such that it can be slid into a rack to automatically engage the plug-in input power contact, first and second load contacts, and plurality of signal contacts.

8. A dimmer module as defined in claim 6, wherein the power device further includes a plurality of light-emitting diodes for indicating the status of predetermined parameters, the diodes being located on a portion of the power device facing the front of the housing.

* * * * *